United States Patent [19]

Yoshida

[11] 4,019,897

[45] Apr. 26, 1977

[54] DESULFURIZING AND INOCULATING AGENT FOR MOLTEN IRON

[75] Inventor: Hiroshi Yoshida, Kasukabe, Japan

[73] Assignee: Aikoh Co., Ltd., Tokyo, Japan

[22] Filed: Sept. 8, 1975

[21] Appl. No.: 611,084

[30] Foreign Application Priority Data

Aug. 13, 1975 Japan ..... 50-97671

[52] U.S. Cl. ..... 75/58; 75/53; 75/130 A

[51] Int. Cl.[2] ..... C21C 7/02

[58] Field of Search ..... 75/53, 58, 130

[56] References Cited

UNITED STATES PATENTS

| | | | |
|---|---|---|---|
| 3,459,541 | 8/1969 | Hohl | 75/53 |
| 3,656,989 | 4/1972 | Layland | 75/58 |

*Primary Examiner*—Peter D. Rosenberg
*Attorney, Agent, or Firm*—Fay & Sharpe

[57] ABSTRACT

A moulding for the treatment of molten iron characterized in that magnesium particle or powder having a diameter of approximately less than 10 mm is mixed for moulding with 1 – 20% by weight of refractory fibrous material, 0.1 – 10% by weight of organic fibrous material and 0.1 – 10% by weight of binder in the whole amount.

4 Claims, 2 Drawing Figures

DESULFURIZING AND INOCULATING AGENT FOR MOLTEN IRON

Figure 1:
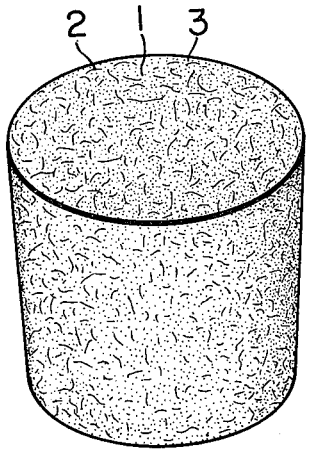

This invention relates to an improvement in a desulfurizing and inoculating agent for molten iron, the major effective component of which is magnesium.

It is conventionally known that metallic magnesium has a distinguished property as desulfurizing, inoculating or the like agent for molten iron. On the contrary, however, there are disadvantages that the magnesium brings about actions such as earlier floating-up, evaporation, oxidation or the like by the heat of molten iron when used because of its light weight, low boiling point and high sensibility, that most of the magnesium may be consumed prior to the actions such as desulfurizing, inoculating, component adding and the like which are regarded as principal reactions with molten iron, and that the reaction efficiency is very bad so that the magnesium must be used in extra and in large quantity.

To avoid these disadvantages there has conventionally been used a method in which magnesium is added in a position as deep as possible below the molten iron level by either an insersion tool or lance, and sometimes it has been tried to add magnesium in mass or grain by means of closed ladle. However, mere insersion or blowing-in of magnesium lacks efficiency to compensate for said disadvantages because magnesium instantly floats up to the molten iron level to cause vaporization, burning or the like and it is hardly possible to increase effect. Closed ladle may prevent magnesium from evaporation since operation is carried out under pressure but it is limited to the ladle of small size in construction. Ladle of large size requires a vast amount of expenditure because its installation has to obtain an anti-pressure strength so that such ladle is industrially useless. In other way it has also been tried to process magnesium in such a manner that it is impregnated with coke, porous refractories and/or sponge iron to avoid reactions at a time, but it is quite impossible to distribute the impregnated magnesium uniformly, causing non-uniform reaction. Furthermore, there have been tried a method in which magnesium is mixed with carbonaceous material or a material which liberates carbon under high temperature, a method in which magnesium is partly coated with a desulfurizing agent and partly provided with a heat insulating layer, and the like method. Since any of the methods intends delayed reaction and uniform distribution of magnesium, however, it is suitably employed only for small amount of molten iron and in ladle of small size.

In the present invention conventional magnesium additives have been improved to act effectivly. According to the invention magnesium in ground grain or powder form having approximately less than 10 mm of particle diameter is mixed for moulding with 1–20% by weight of refractory fiber, 0.1–10% by weight of organic fiber, 0.1–10% by weight of binder and if necessary 10–50% by weight of carbonaceous and/or refractory grain or powder in the total amount or a mixture of said materials other than magnesium is coated as a shell of said moulding.

The refractory fibers in the mixing materials are selected from among asbestos, rock wool, slag wool, glass wool and kaolin fibers, mixing of the selected fibers may promote heat-insulating property and retard the permeation of heat, heat is transmitted gradually from the surface into the interior in the magnesium which is uniformly dispersed in the moulding, and the heat goes on for mean reaction from the surface portion. Accordingly rapid evaporation of the magnesium does not take place, and the magnesium may have good contact with molten iron to increase melting function and effect into the molten iron. Refractory fibers should bear effect with least quantity thereof, but with less than 1% by weight thereof cannot be sufficiently covered even if any kind of refractory fiber were used, and with more than 20% by weight the density of magnesium is too small to produce effect, thus the both being unsuitable.

Said refractory fibers have rigidity so that they are inferior in entanglement among fibers. Organic fibers are employed to reinforce such inferior entanglement and to strengthen the moulding and fix magnesium in the moulding. Thus magnesium is fixed in the moulding as it is uniformly dispersed, causing no transfer, de-foiling or maldistribution during moulding operation or after moulding. As the organic fibers are employed natural or artificial fibers such as pulp, cotton, flax, wool, silk, polyesters and polyamides. In the mixing proportion thereof effect should be produced with least quantity as in the case of refractory fibers but the proportion is determined almost correspondingly with increasing or decreasing tendency of the refractory fibers, with less than 0.1% by weight it will not be effective for the reinforcement of the refractory fibers but with more than 10% by weight heat resistant property will be deteriorated, thus both the cases being unsuitable.

It is same as in conventional methods to use binder for solifiyfing the moulding, but in the present invention organic and inorganic binders can be widely used, being selected from among starches, sugars, protein staches, cellulosic starches, resins, pitch, sodium silicate, aluminum phosphate, colloidal silica, cements and clays. One or two kinds of the selected binders may be suitably used. There is tendency that organic binders are suitable for ladle in which the temperature of molten iron is comparatively low and which is of small capacity and inorganic binders vice versa. In the mixing proportion, with less than 0.1% by weight in the terms of anhydride, binding force will be low, but even if exceeded 10% by weight further binding force will not exert so as to be wasteful.

In order that magnesium is uniformly distributed in mixing and moulding the particle size of magnesium needs be less than 10 mm. However, since the surface area of each particle becomes large in the case of too small particle size, and therefore, reaction becomes violent, there is sometims used carbonaceous, refractory particle or powder to control the reactivity. As the carbonaceous materials are mentioned graphite, coke, charcoal and the refractory materials alumina, bauxite, magnesium oxide, burned or unburned dolomite, vermiculite, which do not affect magnesium. The particle size of these materials may be approximately 0.3 mm in diameter, and it is possible to coat the surface of magnesium together with binder with the carbonaceous and/or refractory materials having said particle size. As regards mixing proportion of these materials, coating will not be sufficient if less than 10% by weight, and organic components will become too short to be unsuitable in use if exceeds 50% by weight.

In order that the mixing materials are mixed and a viscosity of binders is obtained, either water or organic solvent is added and moulding is made pressurization, suction or other suitable method.

The heat-sensibility of the moulding is reduced at high temperature of molten iron so that a shell is sometimes formed with material other than the magnesium comprising said mixing materials. The thickness of the shell will suffice with comparatively thin state such as 2 mm, 5 mm and 10 mm owing to heat insulating property.

The following is the approximate mixing rate of each component which constitutes the shell.

Refractory fibrous material: 20–90% by weight
Organic fibrous material: 5–20% by weight
Binder: 5–20% by weight
Carbonaceous material and/or refractory material (if necessary): 20–60% by weight The thus manufactured moulding may either be inserted into the molten iron by fixing it at the end of an insersion tool or used by fixing it with an inorganic binder at the bottom of ladle or containing it at the additive chamber of converter. When said moulding has contacted molten iron, magnesium melts from the surface of the moulding according to the heat permeation into the molten iron, to be bound with S, $O_2$ and $N_2$ in the molten iron to form slag for floating it up; and when magnesium is added in extra graphite spheroidizing action takes place. Since the magnesium in the moulding is consumed little by little the magnesium may be employed in small quantity and it produces excellent functional efficiency.

The desulfurizing and inoculating agent for molten iron in accordance with this invention will be more specifically described below with reference to the accompanying drawings.

FIG. 1 is a perspective view of the moulding in accordance with this invention, where numeral 1 indicates magnesium particle or powder, numeral 2 refractory fibrous material and organic fibrous material, and reference 3 a mixture of binder, carbonaceous and refractory materials respectively.

Figure 2:
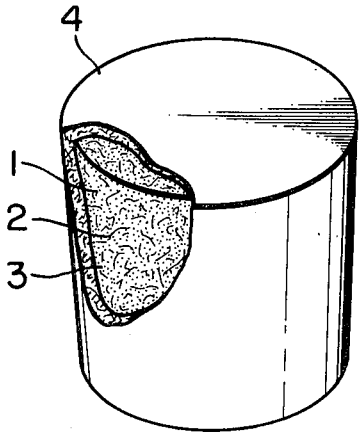

FIG. 2 is a perspective view of a block where the moulding of this invention is made core and shell (4) is coated all over the core.

The following Tables show examples for desulfurizing and graphite spheroidizing of molten iron, in which the moulding of the invention is employed.

TABLE 1

| Moulding No. | | 1 | | 2 | 3 | 4 | 5 | 6 | |
|---|---|---|---|---|---|---|---|---|---|
| Moulding shape | | Core 1 Kg Shell (thickness 5 mm Core | Block Shell | 0.5 Kg Block / | 0.5 Kg Block / | 0.5 Kg Block / | 0.5 Kg Block / | Core 0.5 Kg Shell (thickness 10 mm Core | Block Shell |
| Components (% by Weight) | Magnesium | 35 | — | 50 | 54 | 55 | 84 | 68.9 | — |
| | Slag wool | 10 | 30 | | 15 | 18 | 10 | 1 | 35 |
| | Rock wool | | | 20 | | | | | 45 |
| | Pulp | 2 | 10 | 10 | 8 | 4 | 1 | 0.1 | 5 |
| | Starch | | 5 | 5 | 2 | | | | |
| | Phenol Resin | | | | 2 | | | 10 | |
| | Water glass | | | 5 | 3 | | 5 | | 15 |
| | Aluminum phosphate | 3 | 5 | | | 8 | | | |
| | Magnesia | 20 | 20 | 10 | | 15 | | 20 | 2 |
| | Graphite | 30 | 30 | | 16 | | | | |

Table 2

| Example No. | 1 | 2 | 3 | 4 | 5 | 6 |
|---|---|---|---|---|---|---|
| Moulding No. | 1 | 2 | 3 | 4 | 5 | 6 |
| Molten iron weight in ladle | 5 T open ladle | 5 T open ladle | 5 T open ladle | 5 T open ladle | 1.5 T open ladle | 1.5 T open ladle |
| Adding manner | The addition of moulding is carried out with an insersion instrument | | | | | |
| Adding number of moulding | 5 | 6 | 6 | 6 | 6 | 7 |
| Mg adding weight | 0.35Kg/Ton | 0.30Kg/Ton | 0.32Kg/Ton | 0.33Kg/Ton | 1.7Kg/Ton | 1.6Kg/Ton |
| S content in molten iron before treatment | 0.040% | 0.035% | 0.038% | 0.037% | 0.027% | 0.022% |
| S content in molten iron after treatment | 0.012% | 0.011% | 0.012% | 0.010% | 0.006% | 0.006% |
| Mg content in molten iron after treatment | — | — | — | — | 0.063% | 0.061% |
| Magnesium reaction rate* | 61.5% | 61.0% | 62.0% | 62.5% | — | — |

Note:
*The magnesium reaction rate means a rate where is expressed by percentage the ratio of the practical use amount to a theoretically required amount of magnesium in which S becomes $M_gS$ in the molten iron.

Experiments 1 to 4 intends the desulfurizing of molten iron, and experiments 5 and 6 the adding of magnesium to manufacture spheroidal graphite cast iron. Each experiment was carried out ten times to evaluate mean values.

As comparative examples, in order that the S content after treatment is in the range 0.010–0.015% to 5 ton molten iron in the same ladle, the reaction rate was 10–20% in case pure magnesium was inserted, it was 15–30% when a 50% Mg-Al alloy mass was employed, it was 4–50% when likewise powder of Mg-Al alloy was blown in, and it was 50–60% when coke impregnated with 40% magnesium was inserted. None of the cases could exceed 60% unlike in the present invention.

Further, to make the residue magnesium in the molten iron more than 0.060% to add magnesium, it was required that said 1.5 ton ladle was pressurized with lid applied, and that more than 2.0 Kg/ton of pure magnesium mass was employed under an internal pressure of more than 3–4 Kg/cm$^2$.

What is claimed is:

1. A magnesium base molding for the treatment of molten iron comprising 1 to 20% by weight of refractory fibrous material; 0.1 to 10% by weight of organic fibrous material; in excess of 1.2% by weight magnesium particles, said magnesium particles having a diameter of less than about 10 mm; and 0.1 to 10% by weight of binder.

2. The magnesium base molding of claim 1 which further includes from 10 to 50% by weight of a material selected from the group consisting of carbonaceous particles, refractory particles and mixtures thereof.

3. The magnesium base molding of claim 1 having on its outer surface a shell including 20 to 90% by weight refractory fibrous material, 5 to 20% by weight organic fibrous material, and 5 to 20% by weight binder.

4. The magnesium based molding of claim 3 wherein said outer shell further includes 20 to 60% by weight of a material selected from the group consisting of carbonaceous particles, refractory particles and mixtures thereof.

* * * * *